US006799833B2

(12) United States Patent
Watanabe

(10) Patent No.: US 6,799,833 B2
(45) Date of Patent: Oct. 5, 2004

(54) INK JET RECORDING HEAD AND INK JET RECORDING APPARATUS

(75) Inventor: Yasutomo Watanabe, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/025,540

(22) Filed: Dec. 26, 2001

(65) Prior Publication Data

US 2002/0093550 A1 Jul. 18, 2002

(30) Foreign Application Priority Data

Dec. 28, 2000 (JP) ..... 2000/401120

(51) Int. Cl.[7] ..... B41J 2/05; B41J 2/14; B41J 2/16

(52) U.S. Cl. ..... 347/50; 347/58

(58) Field of Search ..... 347/50, 58

(56) References Cited

U.S. PATENT DOCUMENTS 4,940,413 A * 7/1990 Childers et al. ..... 439/67
5,227,812 A 7/1993 Watanabe et al. ..... 346/140 R
5,796,416 A * 8/1998 Silverbrook ..... 347/47
6,186,613 B1 2/2001 Watanabe ..... 347/17
6,188,414 B1 * 2/2001 Wong et al. ..... 347/42
6,325,488 B1 * 12/2001 Beerling et al. ..... 347/42

FOREIGN PATENT DOCUMENTS

JP 61255866 * 11/1986 ..... 347/58
JP 6-171090 6/1994
JP 7-276644 10/1995

* cited by examiner

*Primary Examiner*—Michael S. Brooke
(74) *Attorney, Agent, or Firm*—Fitzpatrick, Cella, Harper & Scinto

(57) ABSTRACT

An ink jet recording head comprises a flat substrate having an end face and front and back flat main surfaces having a larger area as compared to the end face, an energy generating member for generating energy to be utilized to discharge the ink from a discharge port formed on the front flat main surface side of the substrate, a wiring electrode connected to the energy generating member formed on the front flat main surface of the substrate, and a connection electrode, connected to the wiring electrode, for receiving an electrical signal supplied from outside of the substrate, wherein the connection electrode is provided on another surface, different from the front and back flat main surfaces of the substrate. An ink jet recording apparatus comprises the ink jet recording head and a member for mounting the ink jet recording head.

8 Claims, 5 Drawing Sheets

INK JET RECORDING HEAD AND INK JET RECORDING APPARATUS

BACKGROUND OF THE INVENTION

1. Field of the Invention

The present invention relates to an ink jet recording head and an ink jet recording apparatus.

2. Description of the Related Art

Heretofore, ink jet recording technology, particularly bubble jet recording technology has been rapidly popularized, as color printing and personalized printing have advanced in printing in an office. In short, a bubble jet recording head can easily achieve a high density, a structure having many nozzles and the formation of small liquid droplets, and a recording apparatus can extremely easily achieve compactness, a low cost and a high quality, and is characterized by being easily arranged for various applications by simply changing the design of the head, thereby becoming the principal part of the office.

As regards designing with high quality, particularly with high image quality as described above, the ability to maintain the proper discharge direction during ink discharge exerts a powerful effect on designing with high image quality. That is, in the case where deviation (slippage) in the discharge direction causes an ink droplet to deviate from a position where the ink droplet is to be adhered (ideal placement) and the ink droplet adheres to a position before it reaches the medium (paper in many cases) to which the ink is to be adhered, since the ink dopler does not get fixed on the proper portion of the medium, an unprinted portion of the medium, having a blank stripe, may be produced.

Since the stripe is easily recognized by human vision, it is significant as a deterioration factor of an image, thereby posing one an important subject in ink jet recording. To put it concretely, for example, in the case where a recording head having a discharge amount of 8 pl is used for printing, though it depends on the mode of printing, a deviation of several 10 $\mu$m on the medium is sufficiently recognized as a stripe on the medium. The deviation in the discharge direction is determined by the direction in which the ink droplet is discharged and the distance between the ink discharge port and the medium. That is, the closer the discharge direction to the ideal placement, and the shorter the distance between the ink discharge port and the medium, the smaller the deviation.

If the distance between the ink discharge port and the medium is approximately 0 (zero), the deviation will be 0 (zero) regardless of the discharge direction, but it is difficult to reduce this distance for the following reasons.

1. In the case in which the discharge port comes in contact with the medium, an obstruction may be produced in the discharge port. Furthermore, the ink that has already hit the medium may be scratched by the contact, thereby causing the image to deteriorate.

2. Even in the case in which the discharge port does not contact the medium, as the medium to which the ink adheres absorbs the ink by bringing the discharge port close, the ink swells to become uneven (cockling), the distance between the discharge port and the medium becomes non-uniform, and in the worst case, such an obstruction as described in point 1) above may be produced. Furthermore, since the head side has a convex portion on the medium side rather than merely the ink discharge port, it is necessary to expand the distance between the medium and the ink discharge port by the height of the convex portion. The convex portion may incorporate a sealing material to protect an electric connection electrode from ink formed on an insulation basic body formed thereon with an ink flow path and an energy generating member for discharging the ink in order to transmit an electrical signal or electric power to the energy generating member. In the case where there is no sealing material, since the ink is an electrolyte in many cases, there may be produced an obstruction which causes a wiring electrode or the electric connection electrode necessary for driving the energy generating member formed on the insulation basic body to corrode or dissolve or the like.

3. Therefore, sealing material is necessary, but the sealing material needs to be approximately 0.2 to 0.6 mm high for the distance of 1 to 2 mm between the ink discharge port and the medium, which in turn exerts an adverse influence in terms of deviation of ink placement, which causes the above-mentioned stripe.

SUMMARY OF THE INVENTION

An object of the present invention is to provide an ink jet recording head and an ink jet recording apparatus capable of improved reliability by making the sealing material not to be convex.

An ink jet recording head of the present invention comprises a flat substrate having an end face and front and back flat main surfaces having a larger area as compared to the end face, an energy generating member for generating energy to be utilized to discharge the ink from a discharge port formed on the front flat main surface side of the substrate, a wiring electrode connected to the energy generating member formed on the front flat main surface of the substrate, and a connection electrode, connected to the wiring electrode, for receiving an electrical signal supplied from outside of the substrate, wherein the connection electrode is provided on another surface different from the front and back flat main surfaces of the substrate. Furthermore, an ink jet recording apparatus of the present invention comprises the ink jet recording head and a member for mounting the ink jet recording head.

According to the present invention, it is possible to make the sealing material not to be convex, thereby obtaining an effect to improve the reliability of the ink jet recording head.

DESCRIPTION OF THE PREFERRED EMBODIMENTS

Embodiments of the present invention will be described hereinafter with reference to the accompanying drawings.

First Embodiment

Figure 1:
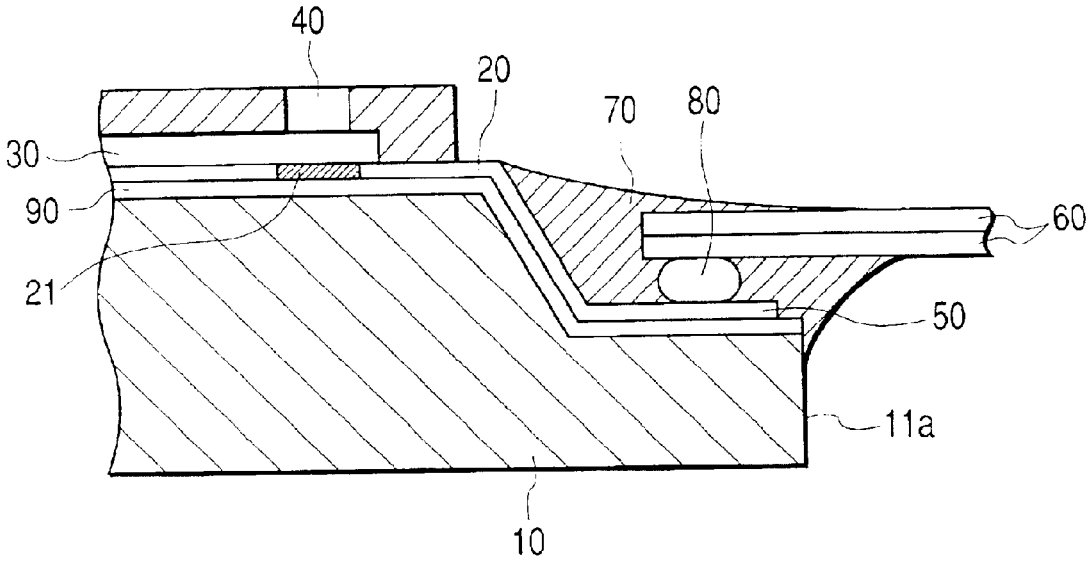
FIG. 1 is a partial sectional view of an ink jet recording head according to a first embodiment of the present invention.

FIG. 1 is a partial sectional view of an ink jet recording head according to a first embodiment of the present invention.

The ink jet recording head according to this embodiment comprises a substrate 10 which is a flat insulation basic body, an energy generating member (heater: electro-thermal conversion body in this embodiment) 21 formed on the substrate 10, a wiring electrode 20 for electrically connecting to the heater, an ink flow path 30 for discharging ink on the heater, an ink chamber, not shown, for supplying the ink to the ink flow path 30, an ink discharge port 40 for determining the discharge direction of the ink, a connection electrode 50 for externally supplying an electrical signal or electric power to the wiring electrode 20, an electric wiring substrate (for example, flexible printed circuit board, TAB or the like) 60 electrically connected to the connection electrode 50, and a sealing member 70 for sealing the connected portion of the connection electrode 50 and the electric wiring substrate 60. The substrate 10 has an end face 11*a* and two main planes of front surface and back surface having a larger area as compared to the end face. A step is provided on the substrate 10 formed thereon with the wiring electrode 20 so as to make the surface formed with the ink discharge port and the surface arranged with the connection electrode 50 to be separate surfaces. The surface arranged with the connection electrode 50 is a surface parallel to the main plane on the surface side of the substrate.

In this embodiment, Si is selected as the material of the substrate 10 formed with the wiring electrode 20. Now, the method of forming thereof will be described.

An Si substrate used as an insulation substrate 10 is a single crystal Si substrate, and the surface direction thereof is desirable to be (100). Using the substrate 10, a resist material for etching is first formed into a pattern on the Si substrate in a desired form by a photolithographic process.

Next, a resist pattern is masked, and dipped in etching liquid (such as KOH) for a predetermined time. After etching, the etching liquid is washed, the resist is peeled, and the formed step is coated with an insulation material. As a method for insulation, there is a method for coating an organic insulation material such as polyamide for example, heating and hardening, and a method for forming an inorganic insulation material such as SiO2 by a vacuum film forming method, and the like.

Next, the energy generating member is connected to an insulation film 90 and connected to the wiring electrode 20 for supplying the electrical signal, thereby to form a pattern of an electric connection material to be formed into the step. Incidentally, for forming the pattern of the electric connection material, there is a method for vacuum film forming of Al, Cu and the like, and a method for printing a thick film of Au, Pd and lime, and the like, and for patterning, there is a method by screen printing and a method by photolithography and the like.

Next, a bump-like electrode 80 is formed on the connection electrode 50. Forming the bump electrode 80 cannot be necessarily said to be indispensable, but by forming the bump electrode 80, it is desirable to form in a manner to remarkably improve the reliability of connection with the wiring electrode 20 for connecting the electrical signal and the like supplied to the electrode 50. As a method for forming the bump electrode 80, there is a method (stud bonding) for forming by ball bonding from a thin wire of Au, or a method for forming by electroforming of Au, Pt and the like, and like methods.

On this bump electrode 80, the wiring substrate (such as TAB, PPC) 60 formed with a desired pattern is positioned and joined. As a method for joining the wiring substrate 60, there is a method for joining by metal bonding, ACF (anisotropic conductive film), and a method for joining by Ag paste, and the like.

After the bump electrode 80 is joined to the wiring substrate 60, the connected portion is sealed with a sealing material 70 in a manner to prevent leaking. Various materials are available as the sealing material 70, but in this case, an epoxy type sealing material with which the reliability can be easily obtained is applied and caused to react and to be hardened by heating. At this point, the convex portion of the sealing material 70 does not extend outward beyond the ink discharge port 40 due to the step formed in a manner as described above, so that there is no influence exerted on the distance between the ink discharge port 40 and the medium.

Second Embodiment

Figure 2:
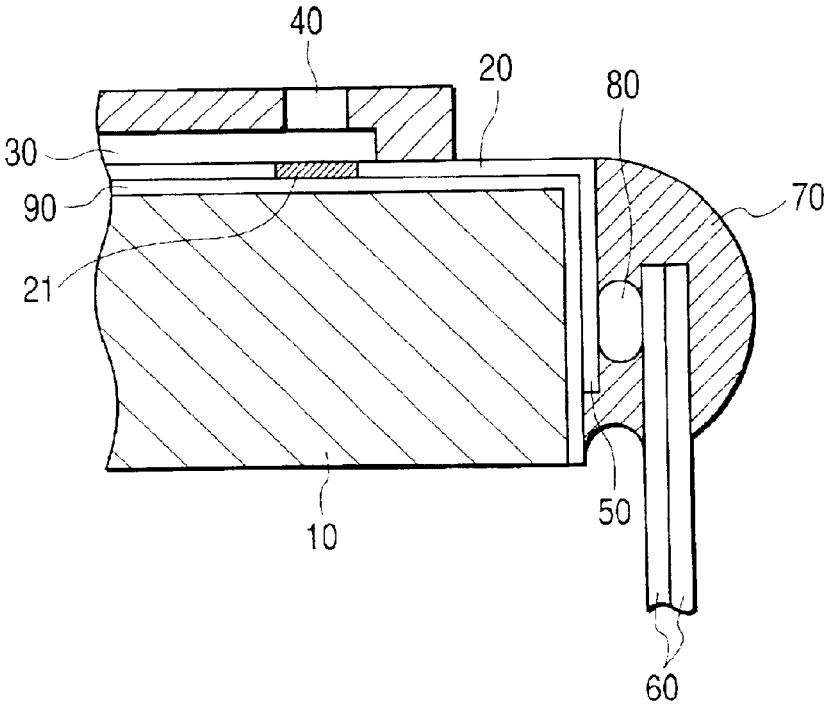
FIG. 2 is a partial sectional view of the ink jet recording head according to a second embodiment of the present invention.

Next, a second embodiment of the present invention will be described based on FIG. 2. Further, FIG. 2 is a partial sectional view showing the ink jet recording head of this embodiment.

The ink jet recording head according to this embodiment comprises a substrate 10 which is an insulation basic body and an energy generating member 21 (heater in this embodiment) formed on the substrate 10, a wiring electrode 20 for electrically connecting to the heater, an ink flow path 30 for discharging the ink on the heater, an ink chamber, not shown, for supplying the ink to the ink flow path 30, an ink discharge port 40 for determining the discharge direction of the ink, a connection electrode 50 for externally supplying an electrical signal or electric power to the wiring electrode 20, an electric wiring substrate (for example, flexible printed circuit board, TAB or the like) 60 electrically connected to the connection electrode 50, and a sealing material 70 for sealing the connected portion of the connection electrode 50 and the wiring substrate 60. A surface substantially vertical (practically 90°) to the surface of the substrate 10 on which the wiring electrode 20 is formed is provided, and the connection electrode 50 for connecting the wiring substrate 60 is formed on the vertical end face.

Therefore, the surface forming the ink discharge port 40 and the surface formed with the connection electrode 50 are arranged as separate surfaces.

The substrate 10 used in this embodiment is a single crystal Si substrate having a surface direction of (100), and the method for forming thereof is as described in the first embodiment.

Third Embodiment

Figure 3:
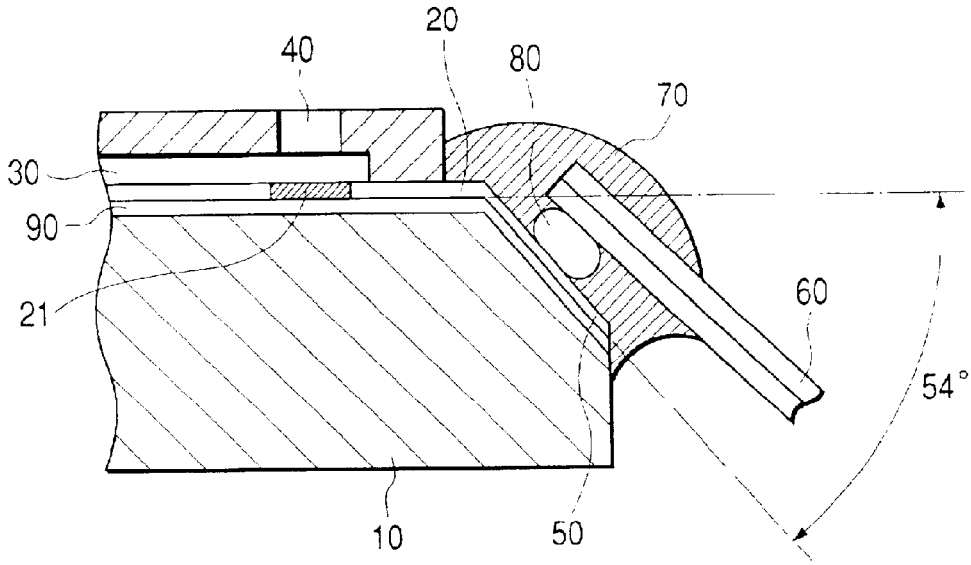
FIG. 3 is a partial sectional view of the ink jet recording head according to a third embodiment of the present invention.

Next, a third embodiment of the present invention will be described based on FIG. 3. Further, FIG. 3 is a partial sectional view showing the ink jet recording head according to this embodiment.

The ink jet recording head according to this embodiment comprises a substrate 10 which is an insulation basic body and an energy generating member 21 (heater in this embodiment) formed on the substrate 10, a wiring electrode

20 for electrically connecting to the heater, an ink flow path 30 for discharging the ink on the heater, an ink chamber, not shown, for supplying the ink to the ink flow path 30, an ink discharge port 40 for determining the discharge direction of the ink, a connection electrode 50 for externally supplying an electrical signal or electric power to the wiring electrode 20, an electric wiring substrate (for example, flexible printed circuit board, TAB or the like) 60 electrically connected to the connection electrode 50, and a sealing material 70 for sealing the connected portion of the connection electrode 50 and the wiring substrate 60. A surface practically inclined 54° to the surface of the substrate 10 on which the wiring electrode 20 is formed is provided, and the connection electrode 50 for connecting the wiring substrate 60 is formed on the inclined surface.

Therefore, the surface on which the ink discharge port 40 is formed and the surface on which the connection electrode 50 is formed are arranged as separate surfaces.

The substrate 10 used in this embodiment is a single crystal Si substrate having a surface direction of (100), and the method for forming thereof is as described in the first embodiment.

Figure 4:
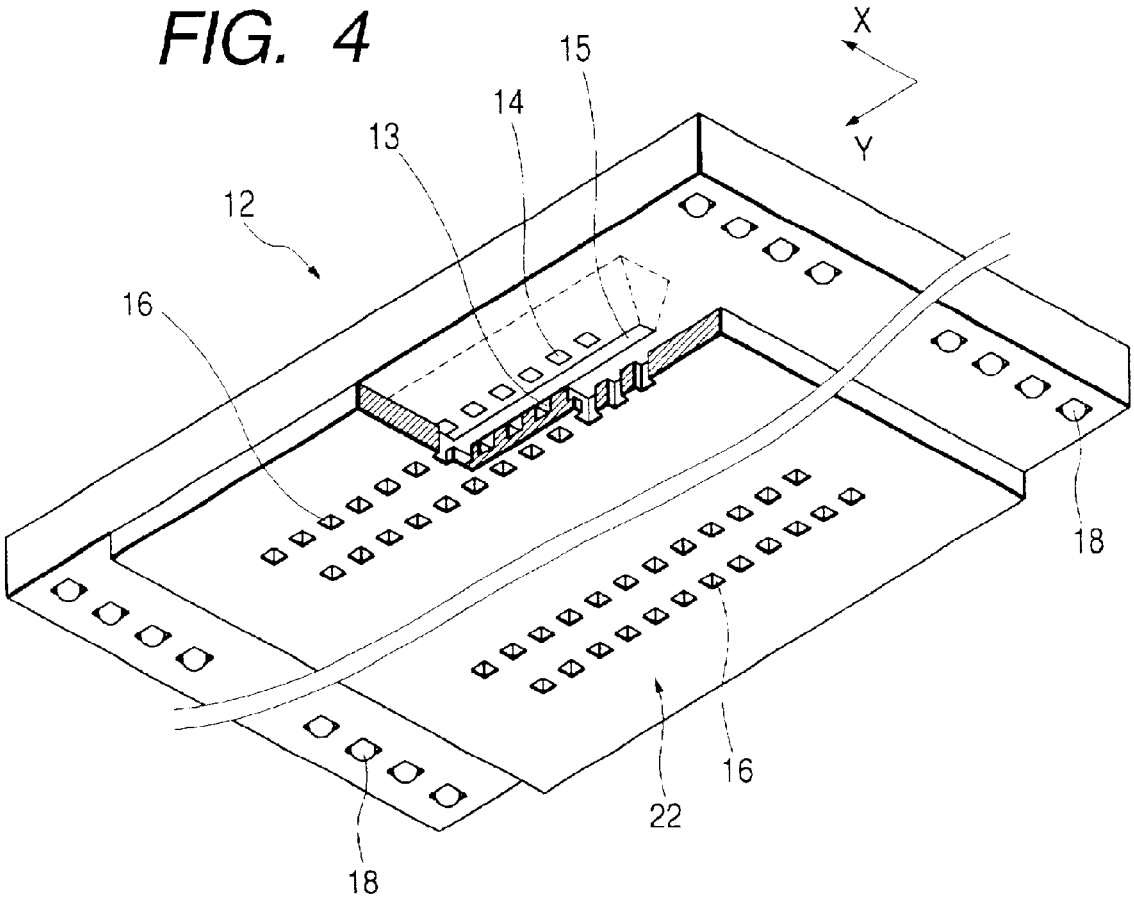
FIG. 4 is a partially broken perspective diagram showing a main portion of an ink jet head according to the embodiments of the present invention.
Figure 5:
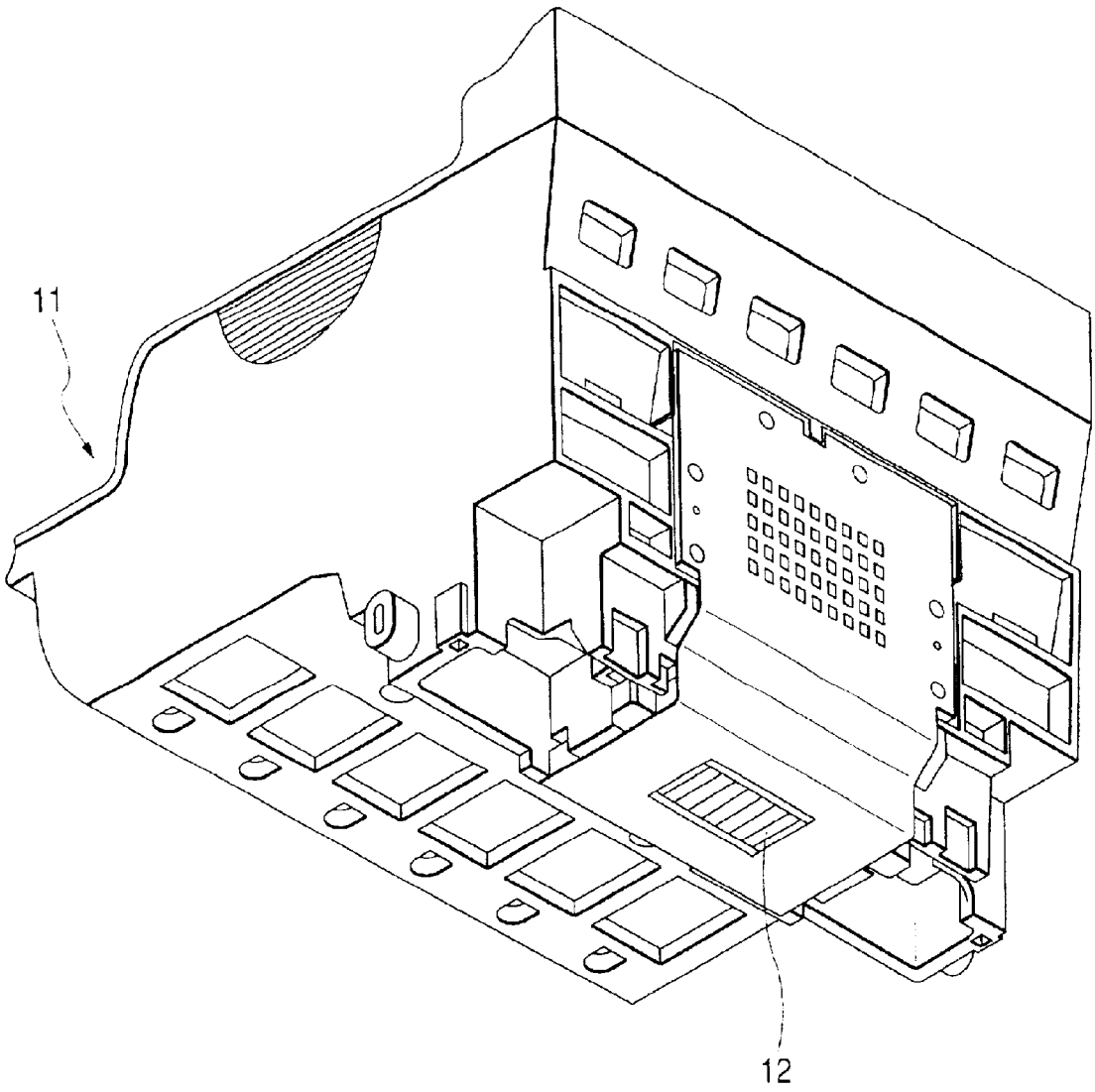
FIG. 5 is a perspective diagram showing an overall appearance of the ink jet head according to the embodiments of the present invention.

The overall appearance of an ink jet head 11 in the embodiments of the present invention is shown in FIG. 5, and a head chip 12 which is a main portion thereof is shown in FIG. 4 in a broken state. The head chip 12 is produced by using an Si wafer 0.5 to 1 mm thick, for example, in which six long and narrow ink supply ports 15 arranged mutually parallel are formed corresponding to the six colors of ink used in this ink jet head 11.

At each ink supply port 15, ink chambers 13 arranged at predetermined intervals along the longitudinal direction of this ink supply port 15 are formed in 2 lines and disposed so as to sandwich the ink supply port 15, and in each ink chamber 13, an electrothermal converting element 14 and a discharge port 16 for discharging the ink as a droplet opposed to this electrothermal converting element 14 are provided.

In this embodiment, since the mutually parallel two lines of the discharge ports 16 sandwiching the ink supply port 15 are mutually shifted by a so-called half pitch in a staggered state, and the ink chambers corresponding to the discharge ports 16 of each line are arranged at a pitch of 600 dpi, the discharge ports 16 to be arranged in the longitudinal direction of the ink supply port 15 corresponding to the ink of each color are arranged, in appearance, at a high density of 1200 dpi. Furthermore, an electrode wiring, not shown, formed with Al or the like for supplying electric power to the electrothermal converting element 14 is formed on the surface of a Si wafer by film forming technology, and the other terminal of the electrode wiring is formed with Au or the like to provide a bump 18 protruding from the surface of the heat generating substrate 12. Not shown in FIG. 4, a peripheral region of the bump 18 has an electrical connecting arrangement as described in FIGS. 1 to 3 in the present invention.

The electrothermal converting element 14 in this embodiment is part of a heat generating resistor layer formed with TaN, TaSiN, Ta-Al or the like, for example, not covered by the electrode wiring formed with Al or the like, and has a sheet resistance value of 53 Ω. Furthermore, these electrothermal converting elements 14 and electrode wiring are covered with a protection layer formed with SiN of 4000 Å thick, and the surface of the protection layer on the electrothermal converting element 14 is formed with a cavitation resistant layer by Ta 2300 Å thick.

The ink supply port 15 utilizes the crystal direction of the Si wafer used as the heat generating substrate 12, and is formed by anisotropic etching. That is, in the case where the surface of the Si wafer is <100>and has the crystal direction of <111>in the direction of the thickness thereof, for example, an alkali type anisotropic etching liquid such as KOH or tetramethyl ammonium hydroxide (TMAH) or hydrazine is used, a selectivity is provided in the etching direction and the surface is etched to a desired depth. Furthermore, the ink chambers 13 and the discharge ports 16 are formed by photolithographic technology, and by supplying electric power to the electrothermal converting element 14, ink droplets of 4 picoliters, for example, are discharged from the discharge ports 16.

Figure 6:
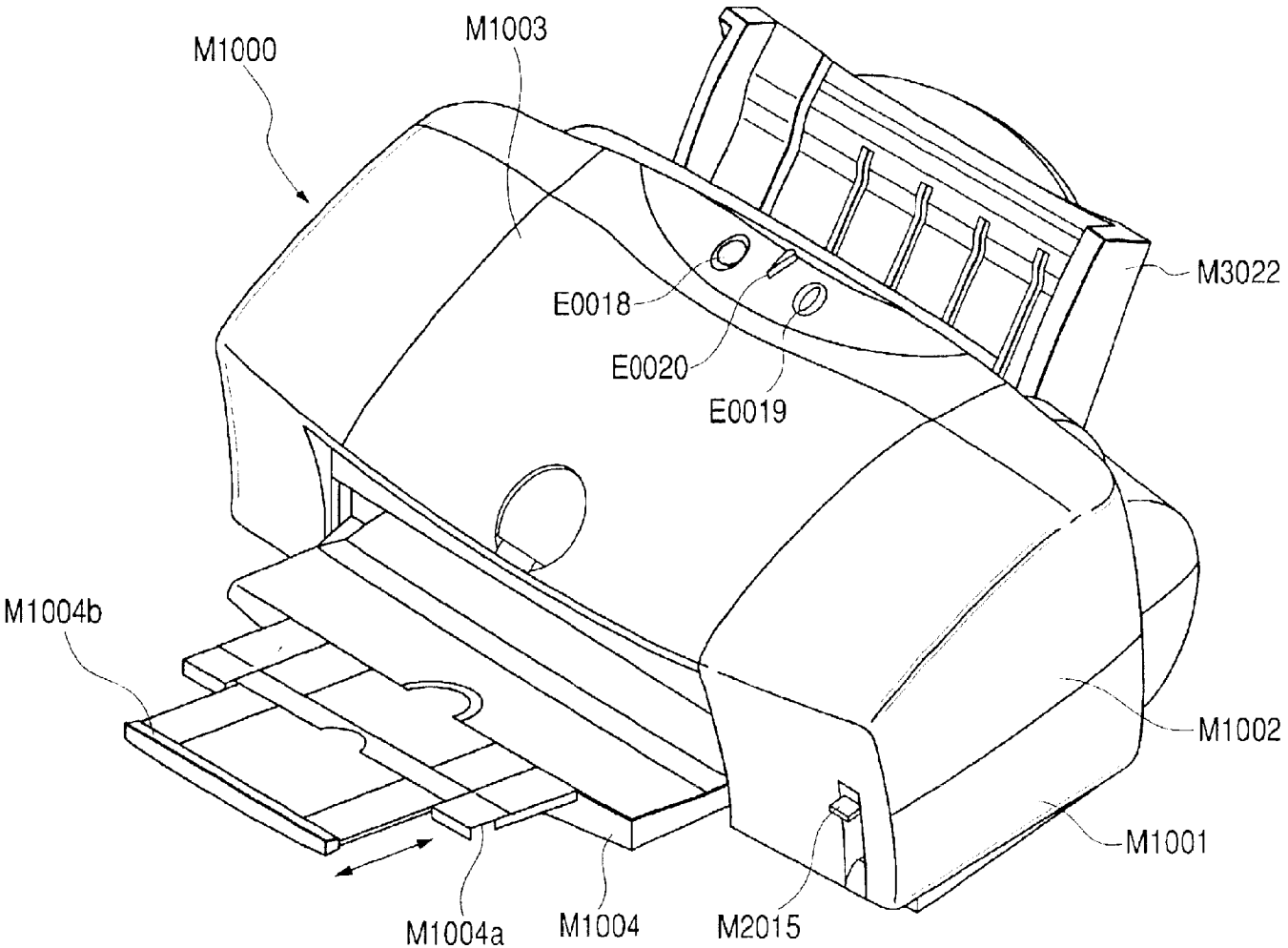
FIG. 6 is a perspective diagram showing an overall appearance of an ink jet recording apparatus according to the embodiments of the present invention.
Figure 7:
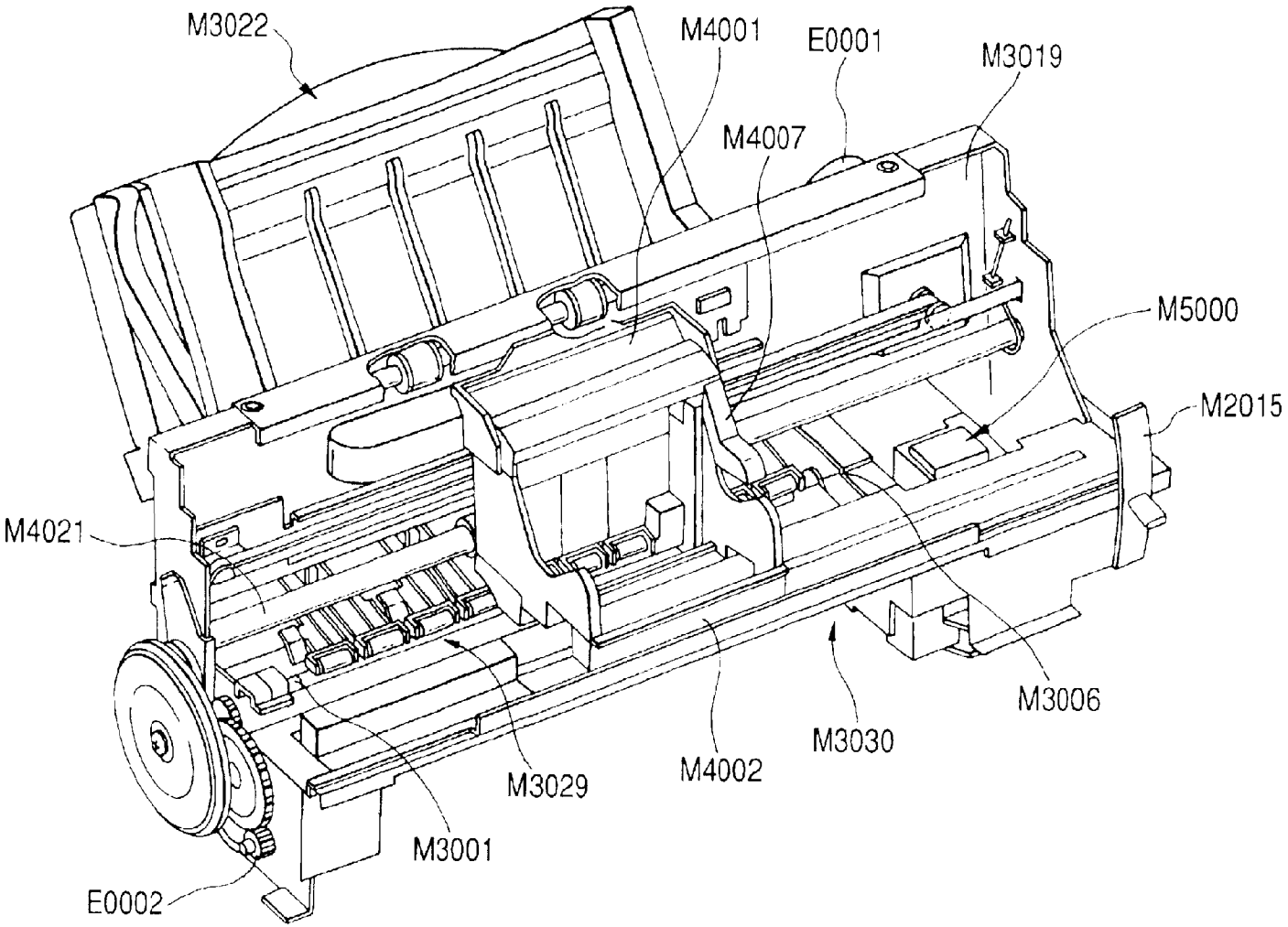
FIG. 7 is a perspective diagram showing a main portion of the ink jet recording apparatus of the present invention.

The general constitution of a printer using an ink jet recording system is shown in FIG. 6 and FIG. 7.

In FIG. 6, an apparatus body M1000 constituting a shell of the printer in these embodiments is constituted by an armoring member comprising a lower case M1001, an upper case M1002, an access cover M1003 and a discharge tray M1004, and a chassis M3019 (refer to FIG. 7) stored in such armoring member.

The chassis M3019 is constituted by a plurality of plate-like metallic members having a predetermined rigidity, forming a framework of a recording apparatus, thereby holding each recording operation mechanism described later.

Furthermore, the lower case M1001 forms the substantially lower half portion of the apparatus body M1000, and the upper case M1002 forms the substantially upper half portion of the apparatus body M1000 respectively, a hollow body structure having a storage space for storing therein each structure described later by combining both cases, and the respective openings are formed on the top and the front thereof.

Furthermore, one end of the discharge tray M1004 is freely rotatably held to the lower case M1001, thereby to open and close the opening formed on the front of the lower case M1001 by the rotation thereof. Therefore, when carrying out a recording operation, by opening the opening by rotating the discharge tray M1004 toward the front, it is possible to discharge a recording sheet therefrom and load the discharged recording sheet P successively. Furthermore, in the discharge tray M1004, two auxiliary trays M1004*a*, M1004*b* are stored, and by pulling out each tray toward the operator as occasion demands, it becomes possible to increase and decrease the supporting area of the sheet in 3 stages.

One end of the access cover M1003 is freely rotatably held on the upper case M1002 to allow opening and closing of the opening formed on the top, and by opening this access cover M1003, it becomes possible to replace a recording head cartridge or an ink tank stored inside the body. Furthermore, though not shown here particularly, when the access cover M1003 is opened and closed, a projection formed on the back thereof causes a cover opening and closing lever to rotate, and by detecting the rotating position of the lever, it becomes possible to detect the opening and closing condition of the access cover.

Furthermore, on the top of the rear of the upper case M1002, a power source key E0018 and a resume key E0019 are provided to allow pressing, and LED E0020 is provided, and when the power source key E0018 is pressed, the LED E0020 comes on and informs the operator that recording is possible. Furthermore, the LED E0020, by changing the method of blinking or the color thereof, or by sounding a buzzer, has various display functions, such as informing the operator of trouble or the like in the printer. Furthermore, in the case in which the trouble or the like is resolved, recording can be restarted by pressing the resume key E0019.

Next, the recording operation mechanism in these embodiments stored and held in the apparatus body M1000 of the printer will be described. As for the recording operation mechanism in this embodiment, it is constituted of an automatic feeding portion M3022 for automatically feeding a recording sheet into the apparatus body, a transfer portion M3029 for leading the recording sheet sent out one by one from the automatic feeding portion to a desired recording position and leading the recording sheet from the recording position to a discharge portion M3030, a recording portion for carrying out a desired recording on the recording sheet transferred to the transfer portion M3029, and a recovery portion M5000 for carrying out a recovery process on the recording portion and the like. The recording portion is mainly constituted of a carriage M4001 movably supported by a carriage shaft M4021, and a recording head cartridge detachably mounted on this carriage M4001.

What is claimed is:

1. An ink jet recording head comprising:

a flat substrate having an end face and front and back flat main surfaces, said front and back flat main surfaces having a larger area as compared to the end face;

a discharge port that has an ink-discharge-side surface and that is formed above the front flat main surface of the substrate;

a wiring electrode connected to an energy generating member formed on the front flat main surface of the substrate, said energy generating member generating energy to be utilized to discharge ink from said discharge port;

a stepped surface provided at an end of the substrate and provided lower than the front flat main surface;

a connection electrode electrically connected to the wiring electrode and provided on the stepped surface;

an electrical wiring member superimposed on the connection electrode and electrically connected to the connection electrode through a bump electrode to supply an electrical signal or electrical power to the connection electrode; and a sealing member for electrically conductively sealing and covering the connection electrode, the bump electrode, and the electrical wiring member on the stepped surface, wherein said sealing member does not extend to the ink-discharge-side surface of said discharge port.

2. The ink jet recording head according to claim 1, wherein the substrate is an insulation substrate made of a single crystal Si material, and wherein a pattern on a surface of the substrate is formed by anisotropic etching.

3. The ink jet recording head according to claim 2, wherein said stepped surface is located in an area of the substrate that becomes thinner in a stepwise fashion in a vicinity of the end face.

4. The ink jet recording head according to claim 3, wherein a surface of said stepped surface is parallel with the front flat main surface of the substrate.

5. The ink jet recording head according to claim 1, wherein the energy generating member is an electrothermal converting element for generating thermal energy.

6. The ink jet recording head according to claim 1, wherein the discharge port is disposed so as to face the energy generating member.

7. An ink jet recording apparatus comprising:

an ink jet recording head having:

a flat substrate having an end face and front and back flat main surfaces, said front and back flat main surfaces having a larger area as compared to the end face;

a discharge port that has an ink-discharge-side surface and that is formed above the front flat main surface of the substrate;

a wiring electrode connected to an energy generating member formed on the front flat main surface of the substrate, said energy generating member generating energy to be utilized to discharge ink from said discharge port;

a stepped surface provided at an end of the substrate and provided lower than the front flat main surface;

a connection electrode electrically connected to the wiring electrode and provided on the stepped surface;

an electrical wiring member superimposed on the connection electrode and electrically connected to the connection electrode through a bump electrode to supply an electrical signal or electrical power to the connection electrode;

a sealing member for electrically conductively sealing and covering the connection electrode, the bump electrode, and the electrical wiring member on the stepped surface, wherein said sealing member does not extend to the ink-discharge-side surface of said discharge port; and a member on which the ink jet recording head is mounted.

8. A method for sealing an electrode of an ink jet recording head, the ink jet recording head comprising a flat substrate, the flat substrate having an end face and front and back flat main surfaces, the front and back flat main surfaces having a larger area as compared to the end face, a discharge port that has an ink-discharge-side surface and that is formed above the front flat main surface of the substrate, the ink jet recording head further comprising a wiring electrode connected to an energy generating member formed on the front flat main surface of the substrate, said method comprising the steps of:

providing a stepped surface at an end of the substrate such that the stepped surface is lower than the front flat main surface;

providing, on the stepped surface, a connection electrode electrically connected to the wiring electrode;

providing an electrical wiring member superimposed on the connection electrode and elecrtically connected to the connection electrode through a bump electrode to supply an electrical signal or electrical power to the connection electrode; and electrically conductively sealing and covering, with a sealing member, the connection electrode, the bump electrode, and the electrical wiring member on the stepped surface, wherein the sealing member does not extend to the ink-discharge-side surface of the discharge port.

* * * * *